US005851651A

United States Patent [19]

Chao

[11] Patent Number: 5,851,651

[45] Date of Patent: Dec. 22, 1998

[54] COATING FOR INKJET RECORDING

[75] Inventor: Hung-Tai Chao, Cumberland, Md.

[73] Assignee: Westvaco Corporation, New York, N.Y.

[21] Appl. No.: 833,542

[22] Filed: Apr. 7, 1997

Related U.S. Application Data

[60] Provisional application No. 60/031,335 Nov. 20, 1996.

[51] Int. Cl.[6] ..... B41M 9/00

[52] U.S. Cl. ..... 428/327; 427/146; 427/391; 428/195; 428/211; 428/327; 428/330; 428/342; 428/409; 428/500; 428/521

[58] Field of Search ..... 347/105; 427/146, 427/372.2, 384, 385.5, 389.9, 391; 428/195, 211, 340–342, 327, 330, 500, 521, 537.5, 409

[56] References Cited

U.S. PATENT DOCUMENTS

| | | | |
|---|---|---|---|
| 4,425,405 | 1/1984 | Murakami et al. | 428/342 |
| 4,503,111 | 3/1985 | Jaeger et al. | 428/195 |
| 5,320,897 | 6/1994 | Koudo et al. | 428/195 |

*Primary Examiner*—Bruce H. Hess

[57] ABSTRACT

The inkjet recording sheet of the present invention comprises a cellulosic sheet support, e.g., paper, bearing on at least one surface thereof an inkjet coating comprising a co-binder system of water soluble and water insoluble binders which are cross-linked during the coating drying process for fixing the images printed with inkjet inks, and a combination of pigment components having a high absorption capacity for absorbing the vehicle of the inkjet inks.

2 Claims, No Drawings

COATING FOR INKJET RECORDING

This application claims the benefit of U.S. provisional application No. 60/031,335, filed Nov. 20, 1996.

BACKGROUND OF INVENTION

The present invention relates to an inkjet recording sheet, and more particularly to an inkjet recording sheet prepared from a cellulosic support such as paper, on which there is applied an inkjet coating providing superior image performance.

The most successful inkjet recording sheets presently in use employ non-cellulosic polymer supports because of their exceptional smoothness. However, as the use of inkjet printers becomes more widespread, there is a growing need for developing inkjet sheets using cheaper and more economical substrates such as paper. The use of paper as a substrate for an inkjet recording sheet provides both advantages and disadvantages. One obvious advantage is cost, but another advantage is the ability of the paper to absorb the ink vehicle rapidly during printing. The main disadvantage is a lack of smoothness as compared with non-cellulosic, polymer substrates.

Inkjet systems are comprised of three components, the printer, the ink and the recording sheet. The printer controls the size, number and placement of the ink droplets and contains the transport system. The ink provides the colorants which form the images, and the recording sheet provides the medium or substrate which accepts and holds the ink. The quality and archivability of ink jet prints is a function of the total system. However, the composition and interaction of the ink and the recording sheet most affect the quality and archivability of the imaged product.

There are two primary requirements for inkjet printing. The first is that the coating, and the substrate in the case of paper supports, must be absorbent enough to immobilize the vehicle of the inks so that the inks will not smear permitting fast ink drying and high printing speeds. The second requirement is that the coating provide a means for keeping the dyes in the inks on the surface of the sheet with minimal spreading, tailing or blurring of dots to provide a sharp image. If the dyes are not kept on the surface of the sheet the colors could fade since the dyes will become diluted by the high light scattering ability of the preferred pigments used in inkjet coatings.

Fast drying properties have been achieved in the past by incorporating silica or other large specific surface area pigments in the inkjet recording layer so as to increase ink absorption. However, an inkjet recording layer with a pigment of large specific surface area provides a surface having low smoothness. As a result, the appearance of the image deteriorates and the reproduction of the image becomes unsatisfactory. Enhanced smoothness can be achieved, however, by calendering or supercalendering the inkjet recording sheet, but this action tends to destroy the porosity of the inkjet recording layer resulting in a decrease in the ink absorption and reduced drying properties. Nevertheless, emphasis in the prior art has dictated the use of nonflake-like pigments for use in inkjet coatings. Nonflake-like pigments include calcium carbonate, silicas, calcined clays and other such pigments whereas flaky pigments include clays, talc and mica.

Typical binders for inkjet coatings disclosed in the prior art are water soluble polymeric binders including polyvinyl alcohol, polyvinyl alcohol copolymers such as poly (vinyl alcohol-co-vinyl acetate), hydroxypropyl cellulose, acrylic resins such as poly (methyl methacrylate/ethyl acrylate/acrylic acid), sodium alginate, water soluble phenol formaldehyde resins, carboxylated styrene butadiene polymers, carboxymethyl cellulose, hydroxyurethanes, soluble collagen gelatin, hydrolyzed ethylene vinyl acetate polymers, and polysaccharides such as xanthene gum, gum tragacanth, locust bean gum, guar gum, and agur, etc. Also noted in the prior art are aqueous dispersions of poly(vinylpyrrolidone), vinylpyrrolidone-vinyl acetate copolymers, or mixtures thereof. U.S. Pat. No. 4,425,405 discloses such a mixture applied on at least one surface of a paper substrate or incorporated internally of the substrate with a white filler in a pigment-to-binder weight ratio of 10:1 to 0.2:1. In addition, U.S. Pat. No. 4,503,111 discloses the use of poly(vinylpyrrolidone) as the binder in an inkjet recording sheet which also incorporates a compatible matrix-forming polymer such as a gelatin or polyvinyl alcohol.

However, in accordance with the present invention, a novel coating formulation has been discovered which utilizes many of the components disclosed in the prior art but which produces superior image performance when applied to a paper substrate and printed with an inkjet printer. The present invention is characterized by a careful blending of water soluble an insoluble binder materials and pigment components to achieve a high level of success.

SUMMARY OF INVENTION

The present invention is directed to an improved inkjet coating sheet comprising a paper substrate having applied to at least one surface thereof an inkjet coating comprising a co-binder system of water soluble and insoluble binders, and a combination of pigments in a moderate pigment-to-binder ratio of about 3 to 1. The preferred pigment combination used in the inkjet coating comprises precipitated calcium carbonate and a styrene-acrylic hollow sphere pigment. The preferred calcium carbonate is a modified product sold under the tradename ECC-4000 by ECC International, designed specifically for the inkjet printing market. The preferred hollow sphere pigment is a product of Rohm & Haas sold under the tradename ROPAQUE HP-1055. The preferred co-binder system for the inkjet coating of the present invention comprises a mixture of polymeric binders consisting essentially of a co-polymer of PVP/styrene, sold under the tradename PROLECTRON-430 by International Specialty Products; a nonionic styrene/butadiene copolymer, sold under the tradename DOW Latex 460 by the Dow Chemical Company; a PVP copolymer (polyvinylpyrrolidone), sold under the tradename LUVIQUAT MS-370 by BASF; and a polyvinyl alcohol product, sold under the tradename VINOL-107 by Air Products and Chemicals. This co-binder system is believed to be cross-linked during the coating drying process to provide superior inkjet printing performance.

In addition to the above defined primary ingredients of the inkjet coating, the coating formulation may contain other additives, e.g., surfactant, humectant, UV absorber, pigment dispersant, defoamer, mold inhibitor, antioxidant, latex, dye mordant and optical brighteners as are known to those skilled in the art. The relative proportion of pigment component to binder component is about 3 to 1, but may be greater or less depending upon the type of pigment used, the type of substrate, and the ability of the binder to adequately hold the pigment to prevent dusting.

Useful substrates include both cellulose and non-cellulose type supports, although cellulose substrates such as paper are preferred. The degree of sizing for the cellulosic substrate can be from 1 second to about 1000 seconds as measured by the Hercules size test (HST), as described in TAPPI standards T530 pm-83. The support is chosen so its HST value is compatible with the volume and composition of the ink drop in the printer to be used. The preferred HST is within the range of from about 200 to 500 seconds, and most preferably between about 300 to 400 seconds. The surfaces of the cellulosic substrate on which the inkjet print coating is applied should be relatively smooth with a BEKK smoothness of about 500 seconds. In addition, cellulosic sheets of high brightness are preferred which have good opacity.

The inkjet coating is applied to one or both surfaces of the substrate by a coating means known to those skilled in the art. Suitable coating methods include conventional roll coaters or blade coating methods, e.g., air, knife, trailing blade, etc. The coating formulation may be applied directly to the surface of the substrate from a single solution or it may be applied over a previously applied holdout coating where desired. The differences between the processes are many, including process speed, coating viscosity, coating solids, types of materials that can be applied, the depth of penetration of the material into the substrate, and the surface characteristics of the substrate coming out of the coating process which ultimately determines the quality of the recording sheet produced.

The inkjet coating is applied to the substrate at a coat weight of from about 2–10 lbs/ream (one or both sides), ream size 3,300 sq. ft, and most preferably at a coat weight of 5–8 lbs/ream. The coating formulation can be made in a variety of ways. A typical coating is made by first taking the most difficult pigment for shearing and adding it to water in which a dispersant has been mixed. The combination of dispersant, water and pigment is agitated at high speeds to develop the shear necessary to break down the pigment into its smallest component parts. The next pigment is then added with additional water and dispersant if necessary. Meanwhile, the binder is prepared, by cooking if necessary, and subsequent cooling to a temperature that will not shock the pigment. The binder or binders are then added to the coating formulation with any other desired additives that are typically used for rheology modification, flow characteristics, stability or functional properties. Following are the pigment/binder components for a typical coating formulation according to the present invention.

TABLE I

InkJet Coating

| Coating Material | Dry Weight (lbs) |
|---|---|
| Precipitated Calcium Carbonate | 2900–3200 |
| Hollow Sphere Plastic Pigment | 400–700 |
| Titanium Dioxide | 0–200 |
| PVP Copolymer (Polyvinylpyrrolidone) | 700–1200 |
| Styrene/PVP Copolymer | 300–400 |
| Styrene butadiene Copolymer | 250–300 |
| Polyvinyl Alcohol Copolymer | 15–100 |

The coating pigments listed in Table I preferably include a modified calcium carbonate material ECC-4000 and a hollow sphere plastic polymer pigment for increased opacity, e.g., ROPAQUE HP-1055. The binder materials used in the coating include LUVIQUAT MS-370, a poly (vinylpyrrolidone) polymeric material; PROLECTRON-430 a copolymer of styrene and poly(vinylpyrrolidone); DOW-460 a styrene/butadiene copolymer; and VINOL-107 a polyvinyl alcohol copolymer. The mixture of poly (vinylpyrrolidone) copolymer, styrene/PVP copolymer and styrene/butadiene copolymer is believed to become cross-linked during the coating drying process to provide superior inkjet printing performance. The different binder components provide good rheology for the coating at high shear, particularly for blade coating. In addition to the above ingredients, a fluorescent whitening agent (FWA T-110) may be added with suitable dispersants and defoamers. This coating batch provides a high quality inkjet coating having a pigment to binder ratio of about 3:1 which is preferably applied to both sides of a suitable paper substrate in an amount of about 2–10 lbs/ream (each side), and most preferably at about 5–8 lbs/ream (ream size 3300 sq. ft). Examples of suitable substrates for the coating are 80–100 lb litho CIS (Coated one side) basestocks sold under the tradenames STERLING and CELESTA by Westvaco Corporation. These products have a smoothness as high as 500 seconds BEKK or higher and a Cobb value (water absorbtivity) of between about 17–54 gr/m$^2$.

Typical examples of coating formulations suitable for the present invention are shown in Table II.

TABLE II

Coating Formulations

| | | 6173 | 6174 | 6175 |
|---|---|---|---|---|
| Hollow-Sphere HP-1055 | lbs. | 700 | 500 | 500 |
| Pigment ECC -4000 | lbs. | 2900 | 3100 | 3100 |
| Alcosperse | lbs. | 16 | 16 | 16 |
| Prolectron - 430 | lbs. | 300 | 300 | 300 |
| Latex D-460 | lbs. | 250 | 250 | 250 |
| PVP (Luviquat-MS-370) | lbs. | 700 | 1100 | 700 |
| PVOH (Vinol-107) | lbs. | 0 | 0 | 0 |
| CMC | lbs. | 40 | 40 | 20 |
| FWA (T-110) | lbs. | 50 | 50 | 50 |
| Defoamer | Pts. | 0 | 8 | 0 |
| Solids (Application) | % | 42 | 50 | 44 |

Each of these coating formulations were applied to three different cellulosic substrates as follows:

A. 80 lb. STERLING Litho C1S

B. 80 lb. STERLING Litho C1S (precoated)

C. 80 lb. CELESTA Litho Dull (precoated)

Each of these substrates are commercial products manufactured by Westvaco Corporation.

After coating, samples of the coated sheets were printed using HP Deskjet 660C, 850C and Design Jet 755 cm color printers. In the evaluation, a number of print characteristics were examined. These included ink bleed of one solid area into another solid area as well as ink bleed into unprinted areas; the color intensity of the inks, particularly the reds; and, the color lay of the black inks. It was found that the use of precipitated calcium carbonate was superior for solid ink bleed and yellow lettering bleed into the solid black area. A combination of precipitated calcium carbonate and hollow sphere pigment produced the best combination of low solid ink bleed and low yellow lettering ink bleed and the best black ink gloss. Ink bleeding deficiency in each case was overcome by increasing the coat weight. This suggested that the ink bleed defect was probably caused when the coating had insufficient pore volume to sufficiently absorb the water associated with the ink. In any event, the above description and examples are only intended to be exemplary of embodiments of the invention and variations and modifications can be made by those skilled in the art that fall within the scope of the appended claims.

What is claimed is:

1. An inkjet recording sheet comprising a paper substrate having a surface smoothness of about 500 seconds BEKK or higher and a Cobb Value (water absorbtivity) of between about 17–54 gr/m$^2$, bearing on at least one surface thereof an inkjet coating comprising a combination of one or more pigments and one or more binders for binding the pigments within the coating structure and for fixing inkjet inks applied thereto, said coating further comprising one or more additives selected from the group consisting of dispersants, lubricants, defoamers, insolubilizers, viscosity modifiers, polyelectroylytes and the like, wherein the pigment to binder ratio is about 3:1, a major portion of the pigment component consists of precipitated calcium carbonate and a hollow sphere plastic pigment, and a major portion of the binder component consists of poly(vinylpyrrolidone); a copolymer of poly(vinylpyrrolidone) and styrene; and a styrene butadiene copolymer wherein the binders are cross linked.

2. The method of making an inkjet recording sheet comprising the steps:

(a) providing a paper basestock having a BEKK smoothness of about 500 seconds, an HST sizing of from about 200–500 seconds and a Cobb value of between about 17–54 gr/m$^2$;

(b) applying to at least one surface of the basestock of step (a) an inkjet coating composition consisting essentially of binder and pigment, said pigment component comprising precipitated calcium carbonate and a plastic hollow sphere pigment, said binder component comprising a co-binder system including a copolymer of poly(vinylpyrrolidone), a copolymer of styrene/poly (vinylpyrrolidone), and a styrene/butadiene copolymer in an amount of from about 3–9 lbs/ream (ream size 3300 sq. ft); and, (c) drying the coating of step (b) at a temperature sufficient to cause the co-binder system to become cross linked.

* * * * *